US006024928A

United States Patent [19]

Foster

[11] Patent Number: 6,024,928

[45] Date of Patent: Feb. 15, 2000

[54] BY-PASS FLOW CATALYTIC CONVERTER

[75] Inventor: Michael Ralph Foster, Columbiaville, Mich.

[73] Assignee: General Motors Corporation, Detroit, Mich.

[21] Appl. No.: 09/094,861

[22] Filed: Jun. 15, 1998

[51] Int. Cl.[7] ..... B01D 53/34

[52] U.S. Cl. ..... 422/176; 422/177; 422/179; 422/180; 422/181; 60/287; 60/288

[58] Field of Search ..... 422/170, 171, 422/174, 172, 176, 180, 179, 177, 181; 60/287–288, 292

[56] References Cited

U.S. PATENT DOCUMENTS 5,315,824 5/1994 Takeshima ..... 422/170

5,575,980 11/1996 Turek ..... 422/181

5,804,147 9/1998 Blanchet et al. ..... 422/180

*Primary Examiner*—Hien Tran

*Attorney, Agent, or Firm*—Vincent A. Chchosz

[57] ABSTRACT

A catalytic converter for an internal combustion engine having a housing provided with an exhaust gas by-pass tube and a valve arrangement that causes the exhaust gas to selectively flow through a catalyst coated substrate to be treated thereby or through the tube so as to exist the converter in an untreated state and in which an actuator is in a sealed relationship with the housing so as to prevent exhaust gas leakage while providing for movement of the valve.

11 Claims, 3 Drawing Sheets

BY-PASS FLOW CATALYTIC CONVERTER

FIELD OF THE INVENTION

This invention concerns catalytic converters for use in the exhaust system of an internal combustion engine and, more particularly, relates to a warm-up catalytic converter having a valve arrangement for selectively causing the exhaust gasses to flow through a catalyst coated substrate for obtaining a catalytic reaction or for causing the exhaust gases to by-pass the substrate so that gasses exit the converter in essentially a non-treated state.

BACKGROUND OF THE INVENTION

It is normal to locate the catalytic converter under the floor of a vehicle at a substantial distance from the engine. As a result, when the engine is first started and the exhaust gas is relatively cool, the efficiency of the converter is reduced and some untreated exhaust gas flows straight out of the tailpipe. In those first few minutes of engine warm-up, it has been found that a substantial amount of tailpipe emissions can occur. As emission regulations are tightened by the Government, automotive engineers are convinced that one of the few areas available for obtaining emission improvement is during the initial cold start-up of the engine. As is well known, catalytic converters are very effective in removing pollutants when hot and therefore it is important to get the converter hot as quickly as possible. As a result, engineers are proposing the use of so called "warm-up" converters which are to be located as close as possible to the engine and be combined with the conventional catalytic converter downstream of the engine.

One form of catalytic converter that has been proposed as a warm-up converter can be seen in U.S. Pat. No. 5,575,980, issued in the name of Alan G. Turek on Nov. 19, 1996, and assigned to the assignee of this invention. The Turek patent discloses a converter that includes a perforated tube in the form of two sets of staggered slots. The tube is surrounded by a catalytic monolith composed of a series of alternating herringbone patterned foil sheets coated with a noble metal catalytic material. A valve is located in the tube downstream of the catalytic monolith and when the valve is in its closed position, the exhaust gas entering the tube passes through the slots in the tube and then flows radially through the monolith to catalytically react with the noble metal catalyst on the foil sheets. Once the exhaust gas is at or near the light-off or operational temperature of the downstream main catalytic converter, the valve is moved to the open position so that the exhaust gas flows entirely through the tube and is delivered in its heated state to the main catalytic converter.

SUMMARY OF THE INVENTION

The present invention is directed to a catalytic converter of the type disclosed in the above-mentioned Turek patent but differs therefrom in that the catalytic monolith is made of a frangible material such as ceramic that is extruded with a honeycomb cross section and has dense cells so as to provide more surface area to convert the hydrocarbons while giving quicker light-off. The converter has an exhaust gas bypass tube located within its housing and the catalytic monolith is arranged around the tube in a manner that permits retention of the monolith at a low cost. The catalytic converter according to the present invention also differs from the Turek converter in that the motor actuator for controlling movement of the valve is sealingly connected to the converter housing so as to prevent exhaust gas leakage while at the same time exposing an operating part of the motor actuator to the exhaust gas pressure so that automatic opening of the valve occurs if maximum engine power is required prior to engine warm-up.

One object of the present invention is to provide a new and improved catalytic converter for an internal combustion engine that includes a housing supporting a tube located therein and having a catalyst coated substrate made of ceramic material located on diametrically opposed sides of the tube and having a valve mounted in the tube for movement to a first position wherein the exhaust gas flows through the substrate for removal of pollutants from the exhaust gas and to movement to a second position wherein the exhaust gas by-passes the substrate and flows through the tube directly to a gas outlet opening.

Another object of the present invention is to provide a new and improved catalytic converter for an internal combustion engine that incorporates a valve which, depending upon its position, allows the exhaust gas to flow through a catalyst coated substrate or causes the exhaust gas to by-pass the substrate and exit the converter in an untreated state and in which the valve is movable by a motor actuator having an operating part thereof exposed to the exhaust gas entering the converter.

A further object of the present invention is to provide a new and improved catalytic converter for an internal combustion engine having a housing provided with an exhaust gas by-pass tube and a valve arrangement that causes the exhaust gas to selectively flow through a catalyst coated substrate to be treated thereby or through the tube so as to exist the converter in an untreated state and in which an actuator is sealingly connected to the housing so as to prevent exhaust gas leakage while providing for movement of the valve.

A still further object of the present invention is to provide a new and improved catalytic converter for an internal combustion engine that is oval-shaped and has a centrally located exhaust gas by-pass tube surrounded at opposed sides by a pair of catalyst coated substrates made of a ceramic material and in which the converter is characterized in that a valve is mounted in the tube and operated by a diaphragm type motor that is sealingly connected to the housing of the converter.

The above objects and others are realized in accordance with the present invention by a by-pass flow catalytic converter adapted to form a part of the exhaust system of an internal combustion engine. The catalytic converter includes a housing having a cavity formed therein terminating at one end with a gas inlet edge and terminating at the other end with a gas outlet edge. A pair of end members are provided one of which is sealingly connected to the gas inlet edge of the housing and the other of which is sealingly connected to the gas outlet edge of the housing. One of the end members has a gas inlet opening for allowing the exhaust gas to enter the housing and the other of the end members is provided with a gas outlet opening for allowing the exhaust gas to pass through the outlet opening to the main catalytic converter of the exhaust system for further treatment. A by-pass tube is located in the cavity of the housing and is axially aligned with the gas inlet opening and the gas outlet opening. A catalyst coated substrate wrapped with a mat of insulating material is located on diametrically opposed sides of the tube and has a plurality of parallel passages through which the exhaust gas is adapted to flow and be treated by the substrate for removing pollutants therefrom. The substrate has a gas inlet face and a gas outlet face with the gas inlet face being spaced from the adjacent end member to form a gas inlet chamber. Similarly, the gas outlet face is spaced from the associated end member to form a gas outlet chamber. The gas inlet end of the by-pass tube terminates at a point substantially transversely aligned with the gas inlet face of the substrate and has a valve supported therein for movement to a first position wherein the gas inlet end of the tube is closed so that the exhaust gas is required to flow through the substrate and through an opening in the side wall of the tube to the gas outlet opening. It would be obvious to anyone skilled in the art that the gas inlet end and the gas outlet end could be reversed, with no change in construction and without a substantial loss of function. The valve is also movable to a second position wherein the gas inlet end of the tube is opened to allow unrestricted gas flow through the converter. In addition, an actuator is mounted on the outside of the housing for moving the valve between the aforementioned first and second positions.

BRIEF DESCRIPTION OF THE DRAWINGS

Other objects, advantages, and features of the present invention will be more apparent from the following detailed description when taken in conjunction with the drawings in which.

DETAILED DESCRIPTION OF THE DRAWINGS

Figure 1:
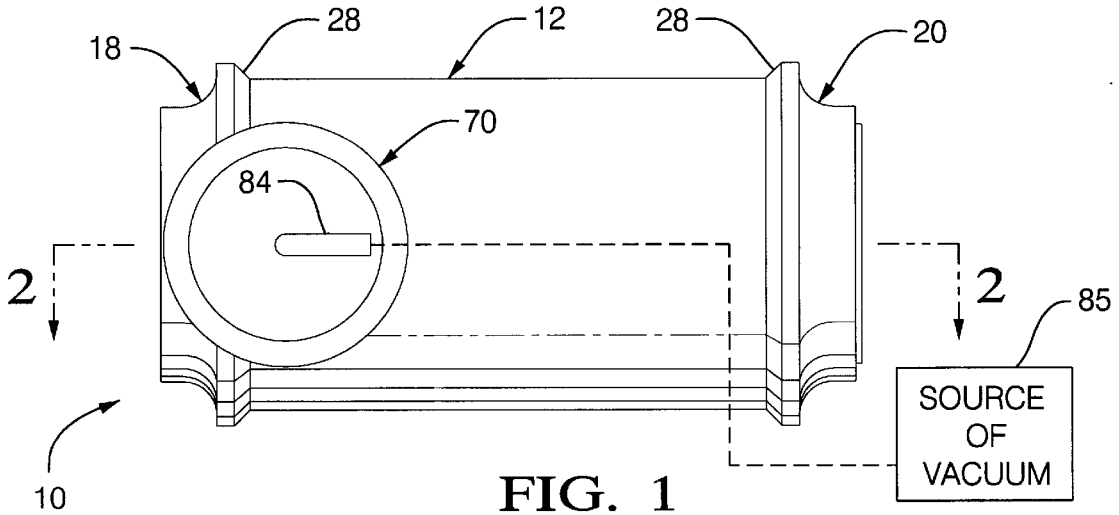
FIG. 1 is a side elevational view of a catalytic converter made in accordance with the present invention.
Figure 2:
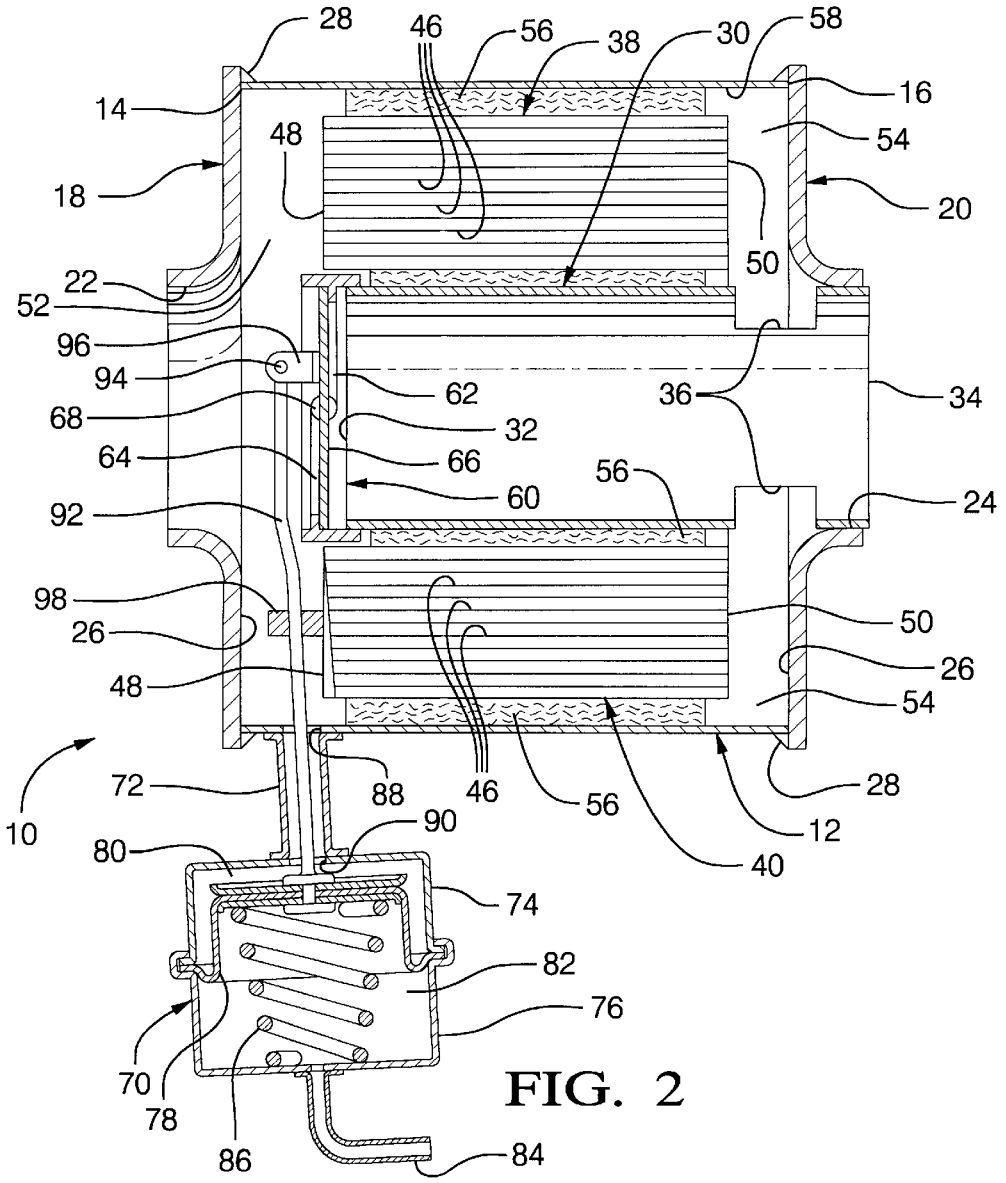
FIG. 2 is a sectional view of the catalytic converter taken on line 2—2 showing the valve incorporated in the by-pass tube of the converter located in the closed position so as to cause the exhaust gas entering the converter to flow through the catalyst coated substrate located on opposed sides of the by-pass tube.
Figure 5:
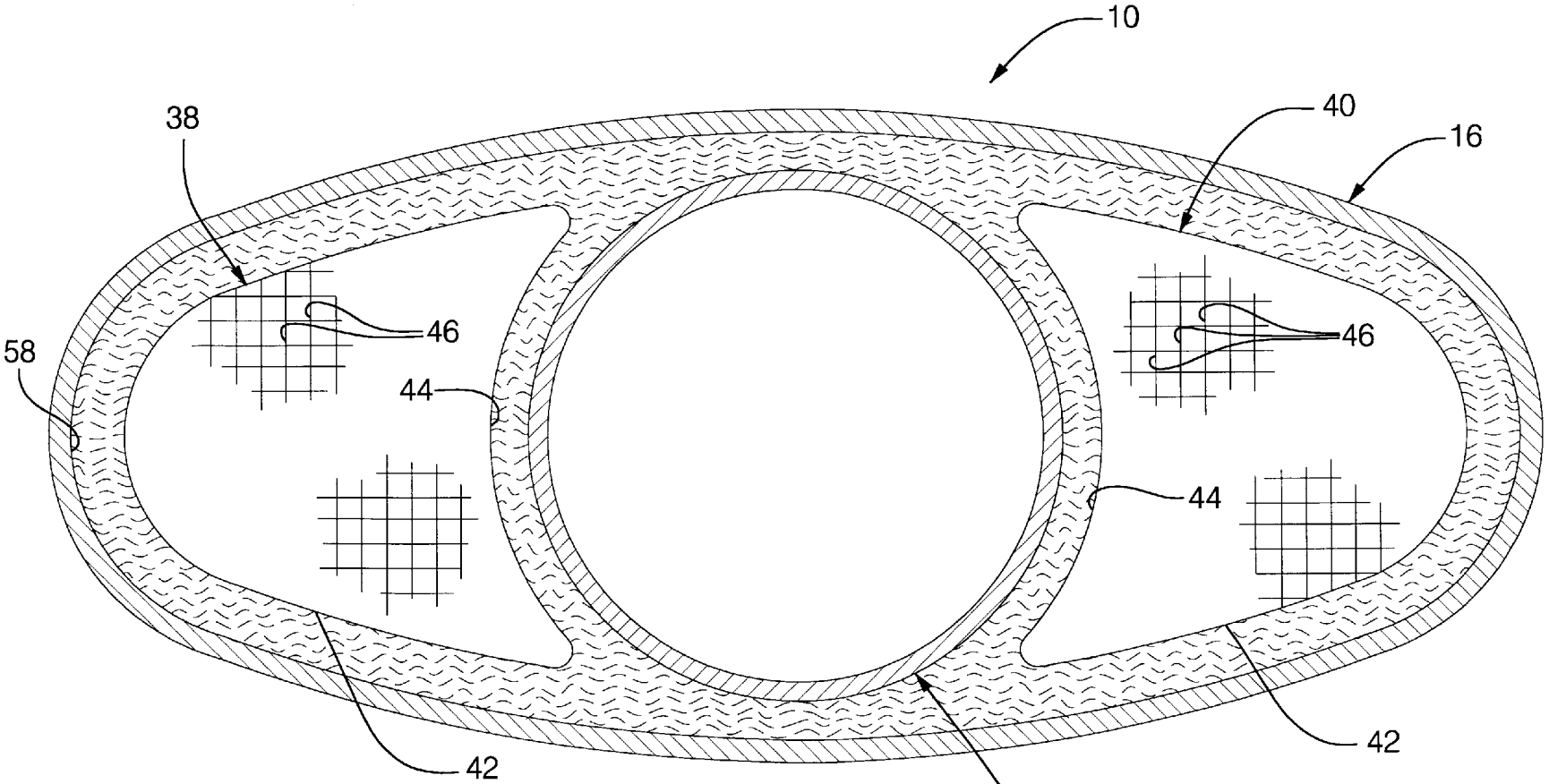
FIG. 5 is an enlarged sectional view taken on line 5—5 of FIG. 3.

Referring to the drawings and more particularly to FIGS. 1 and 2 thereof, a warm-up or by-pass flow catalytic converter 10, made in accordance with the present invention, is shown for use in eliminating the initial discharge of unburned hydrocarbons produced while an internal combustion engine (not shown) warms up after a cold start. It will be understood that the catalytic converter 10 is intended to be positioned as close as possible to the engine (not shown) for most efficient operation. As seen in FIG. 5, the catalytic converter 10 has an oval cross-sectional configuration however, as should be apparent, the converter 10 can have any other low-profile cross sectional configuration that allows it to be located in a space-constrained area of the vehicle.

As seen in the FIGS. 1 and 2, the catalytic converter 10 comprises a housing 12 which terminates at its front end with an oval-shaped edge 14 defining an oval gas inlet end located in a plane extending transversely to the longitudinal center axis of the housing 12. Similarly, the rear end of the housing 12 terminates with an oval-shaped edge 16 defining an oval gas outlet end located in a plane parallel to the plane passing through the edge 14. The housing 12 is made of a sheet of stainless steel or other material suitable for operation in a high temperature exhaust gas environment and is provided with a uniform oval cross-sectional cavity along its entire length.

The front and rear open ends of the housing 12 are respectively closed by an oval-shaped gas inlet end member 18 and a similarly shaped gas outlet end member 20. The inlet end member 18 is formed with a circular gas inlet opening 22 defined by a radius transition adapted to be connected to a cylindrical exhaust gas inlet pipe (not shown) which, in turn, is connected to the engine. The outlet end member 20 is formed with a circular gas outlet opening 24 also provided with a radius transition adapted to be secured to a cylindrical exhaust pipe (not shown) leading to the main catalytic converter (not shown) forming a part of the exhaust system in which is located the catalytic converter 10. The end members 18 and 20 are essentially planar in configuration providing a flat inner surface 26 for engagement with the associated edge of the oval opening at each end of the housing 12. Also, as shown, each of the end members 18 and 20 has its peripheral portion extending radially outwardly beyond the outside surface of the housing 12 for accepting a weld 28 for sealingly securing each of the end members 18 and 20 to the housing 12.

Figure 4:
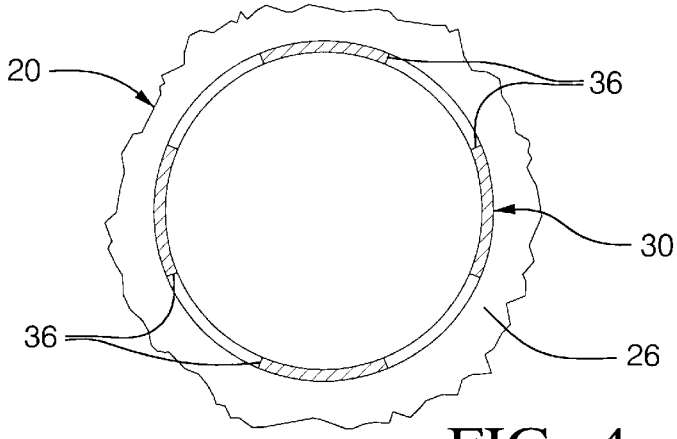
FIG. 4 is an enlarged sectional view of the by-pass tube taken on line 4—4 of FIG. 3.

An exhaust gas by-pass tube 30 is centrally located in the cavity of the housing 12 and is axially aligned with the gas inlet opening 22 in the end member 18 and the gas outlet opening 24 in the end member 20. The tube 30 is provided with a gas inlet end 32 and a gas outlet end 34 the latter of which is fixedly secured within the gas outlet opening 24 of the end member 20. Adjacent the gas outlet end 34 of the tube 30, a plurality of generally square openings or perforations 36 are provided in the tube 30. As seen in FIG. 4, the openings 36 in the tube are circumferentially equally spaced around the body of the tube 30 and serve a purpose which will be explained hereinafter.

As best seen in FIGS. 2 and 5, a pair of identically shaped monoliths or substrates 38 and 40 are positioned on diametrically opposed sides of the tube 30. Each of the substrates 38 and 40 is made of a frangible material such as ceramic that is extruded with a dense honeycomb cross section and has a surface portion 42 of its outer configuration that is generally half-oval for conformance with the shape of the opposed sides of the cavity within the housing 12. In addition, the remaining outer surface portion 44 of each substrate 38 and 40 located adjacent the tube 30 is concave in configuration for conformance with the outer shape of the tube 30. Each of the ceramic substrates 38 and 40 is coated with a precious metal such as platinum and/or palladium and/or rhodium. The catalyst serves to purify the exhaust gases exiting the internal combustion engine by entering the plurality of parallel flow passages 46 of each substrate 38 and 40 at the front inlet face 48 thereof and exiting the rear outlet face 50 thereof. The purification of the exhaust gases occurs by reduction and oxidation processes well know to those skilled in the art. Also, at this juncture, it will be noted that the front face 48 of each of the substrates 38 and 40 and the inner surface 26 of the inlet end member 18 define a gas inlet chamber 52 while the rear face 50 of each of the substrates 38 and 40 and the inner surface 26 of the outlet end member 20 define a gas outlet chamber 54.

Both of the substrates 38 and 40 are supported within the housing 12 by a mat 56, a part of which can take the form of an oval-shaped sleeve. The sleeve part of the mat 56 is interposed between the inside surface 58 of the housing 12 and the outer half-oval surface portion 42 of each substrate 38 and 40 and another part of the mat 56 is interposed between the concave surface portion 44 of each of the substrates 38 and 40 and the tube 30. The sleeve portion of the mat 56 extending along the inner surface 58 of the housing 12 is made from a resilient, flexible and heat expandable intumescent material such as that known by the trade name "Interam" and is manufactured by the Technical Ceramics Producst Division of 3M Company of Minneapolis, Minn. The portion of the mat 56 located between the concave surface of each of the substrates 38 and 40 and the tube 30 is made of a ceramic fiber without mica. The density of the mat 56 is such that it serves as a seal to prevent the hot exhaust gases from flowing through the area between the outer surface of each substrate 38 and 40 and the inner surface 58 of the housing 12 as well as the area between the outer surface of the tube 30 and the concave surface 44 of each substrate 38 and 40. The mat 56 also serves as the sole means for maintaining the substrates 38 and 40 in a fixed position relative to the housing 12 and the tube 30. In addition, the mat 56 serves as an insulator for limiting heat transfer between the substrates 38 and 40 and the housing 12 during the time that the hot exhaust gases flow through the substrates 38 and 40.

The gas inlet end 32 of the tube 30 has a cylindrical shroud 60 fixed thereto that is integrally formed with radially inwardly extends lands 62 and 64. The shroud 60 supports a circular butterfly type valve 66 for pivotal movement with a pivot shaft 68 between a closed position as seen in FIG. 2 and an open position seen in FIG. 3. When in the closed position of FIG. 2, the valve 66 cooperates with the lands 62 and 64 to seal the gas inlet end 32 of the tube 30 and thereby prevent the exhaust gas from passing through the tube 30. On the other hand, when the valve 66 is located in the open position of FIG. 3, the exhaust gas can flow through the tube 30 to the gas outlet end 34 of the tube 30 and exit the catalytic converter 10 for treatment by the main catalytic converter.

Figure 3:
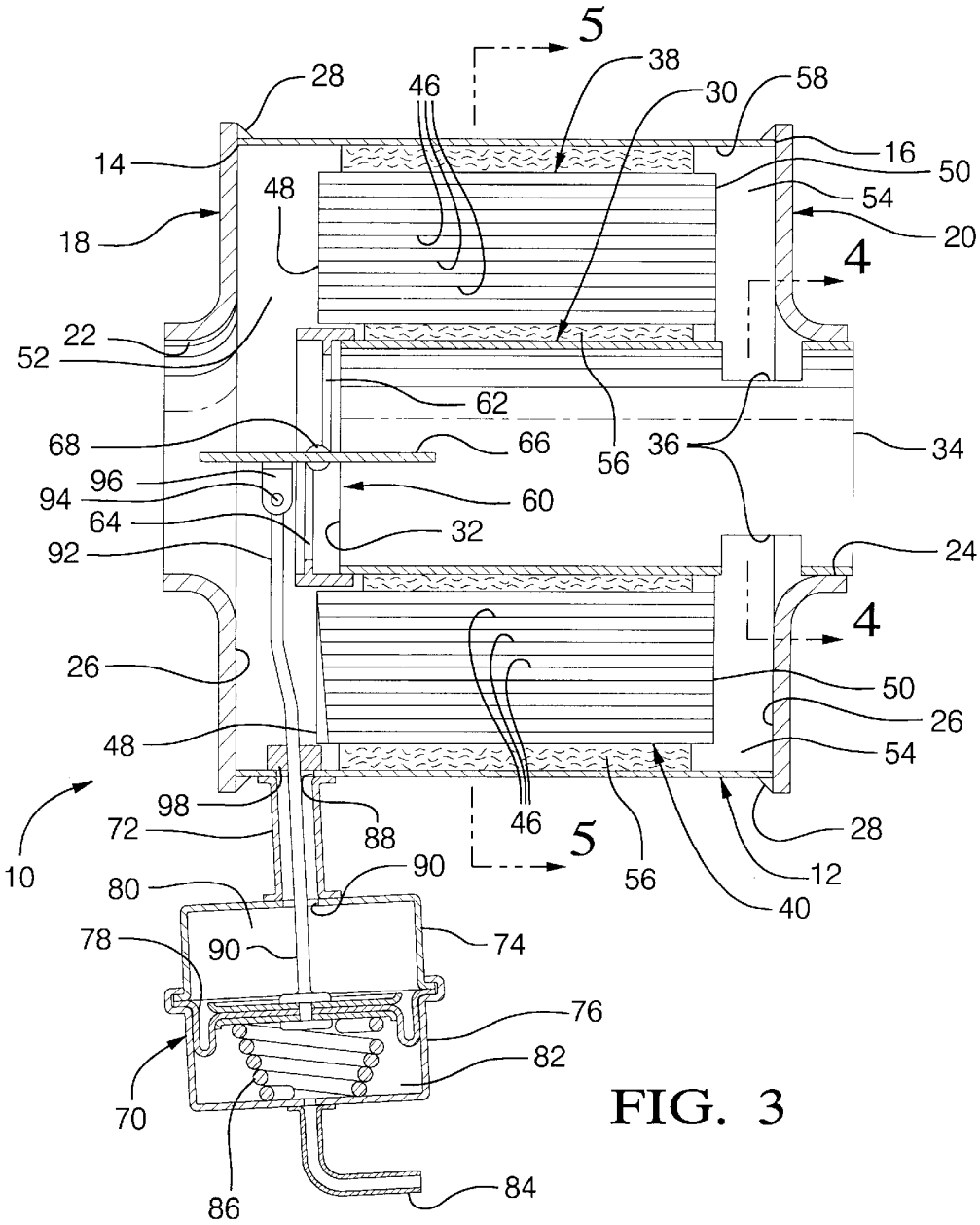
FIG. 3 is a view similar to that seen in FIG. 2 with the valve in the open position for allowing the exhaust gas to bypass the substrate and flow directly from the gas inlet opening to the gas outlet opening of the converter.

An actuator mechanism is provided for positioning the valve 66 between the aforementioned positions and includes a vacuum motor 70 attached through a tubular member 72 to one side of the housing 12. The motor 70 includes two cup-shaped sections 74 and 76, the circular outer edges of which are crimped together with a disk-shaped diaphragm 78 located therebetween. Thus, the circular peripheral edge of diaphragm 78 is clamped between the two sections 74 and 76 and sealingly divides the motor into a pair of chambers 80 and 82. The chamber 82 is connected through a hose 84 with a source of vacuum 85 provided by the engine intake manifold and has a coil spring 86 located therein. The other chamber 80 is adapted to communicate through the tubular member 72 and through an opening 88 in the curved side wall of the housing 12 with the gas inlet chamber 52 located in the housing 12. In this regard, it will be noted that inner end of the tubular member 72 is scaled around the opening 88 in the housing 12 while the outer end of the tubular member 72 is sealed around an opening 90 provided in the section 74 of the motor 70. It will also be noted that the center of the diaphragm 78 is rigidly connected through disk-shaped plates on the opposed sides of the diaphragm 78 to one end of a link 92 which extends through the tubular member 72 and has its other end connected by a pivotal connection 94 to a bracket 96 secured to the valve 66 adjacent its pivot shaft 68. Substantially midway between the opposed ends of the link 92, a metallic member 98 is fixedly mounted on the link 92 and, as seen in FIG. 3, is adapted to substantially close the passage within the tubular member 72 leading to the chamber 80 of the vacuum motor 70. This is important in that, once the main catalytic converter reaches its light-off temperature and the valve 66 is in the open position of FIG. 3, the member 98 shields the opening 88 and substantially prevents the hot exhaust gas generated by the engine from entering the chamber 80 and causing the diaphragm 78 to deteriorate.

In operation, when the engine is first started, the vacuum motor 70 will be disconnected with the source of vacuum 85 so that the spring 86 in the chamber 82 will cause the diaphragm 78 to assume the position of FIG. 2. As alluded to hereinbefore, in this position of the diaphragm 78, the link 92 will position the valve 66 in the closed position so that the exhaust gas entering the catalytic converter 10 will be required to flow through the two substrates 38 and 40 into the gas outlet chamber 54 and then through the openings 36 in the tube 30 and finally through the gas outlet opening in the end member 20 to the exhaust system components downstream of the catalytic converter 10. As the exhaust gas passes through the substrates 38 and 40, it catalytically reacts with the noble metal catalyst to remove pollutants from the exhaust gas. Because the converter 10 will be located close to the engine, the hot exhaust gases flowing through the substrates 38 and 40 will cause a catalytic reaction therebetween with the result that the light-off temperature of the converter downstream of converter 10 will be reached very quickly.

As the catalytic converter 10 reacts with the exhaust gas, the exhaust gas is heated and is then delivered to the main catalytic converter in the exhaust system for further treatment. When the exhaust gas has reached a sufficiently high temperature so that the main catalytic converter is at or near its light-off temperature, the source of vacuum 85 will be connected with the chamber 82 of the vacuum motor 70. The higher pressure on the other side of the diaphragm 78 will then overcome the force of the spring 86 and cause the diaphragm 78 to move to the position of FIG. 3. As the diaphragm 78 moves from the position of FIG. 2 to that of FIG. 3, the link 92 will cause the valve 66 to rotate to the open position of FIG. 3 so that the plane of the valve 66 is parallel to the flow of the exhaust gas and the member 98 shields the opening 88. As a consequence, the exhaust gas will now flow directly through the tube 30 to the gas outlet opening 24 in the end member 20 and by-pass the catalyst substrates 38 and 40.

Although not shown, it will be understood that the operation of the actuator mechanism which forms a part of the catalytic converter 10 will be controlled by a system that includes the electronic engine control module (ECM). Thus, if desired, a temperature sensor can be provided in the exhaust system for sensing the exhaust gas temperature aft of the catalytic converter 10 and for sending a signal indicative thereof to the ECM. So long as the exhaust gas is at a temperature below a predetermined temperature, the valve 66 will remain in the closed position of FIG. 2. When the exhaust gas temperature reaches the light-off temperature of the main catalytic converter downstream of the converter 10, the ECM module can then connect the source of vacuum 85 to the vacuum motor 70 to cause the diaphragm 78 and the valve 66 to move to the position of FIG. 3 so that the tube 30 will be opened for bypass flow. Rather than having a temperature sensor in the exhaust system, the ECM could sense the operating conditions of the engine for determining whether the downstream temperature is adequate for causing the converter 10 to assume the by-pass position of FIG. 3.

One advantage in having the vacuum motor 70 connected to the housing 12 in the manner described above is that the link 92 is located in a sealed compartment so that exhaust gas cannot be leaked to atmosphere. In addition, by having the gas inlet chamber 52 communicate with the chamber 80 of the vacuum motor 70 when the engine is cold started, the valve 66 can be moved to the open position if maximum engine power is required at start-up. In other words, because the diaphragm 78 is exposed to the exhaust gas pressure during engine start-up as explained above, if the engine is called upon to provide increased power immediately, the increased rpm's will cause increased exhaust gas pressure which will then act on the diaphragm 78 and overcome the force of the spring 86 to move the valve 66 to the open position so that the engine develops the needed horsepower for immediate vehicle acceleration. However, during normal conditions when the engine is cold-started and is operated at less than maximum power, the relatively low exhaust pressure generated by the engine will not be strong enough to overcome the force of the spring 86 so that the valve 66 will remain in the closed position. Also, the use of two catalyst substrates 38 and 40 supported by a central tube 30 as provided by the catalytic converter 10 permits robust retention of the substrates at low cost. This is important for a warm-up catalytic converter having substrates made of ceramic material that are low in thermal mass. Low thermal mass substrates tend to be relatively weak and prone to breakage during canning and due to expansion forces generated by the insulating mat.

Various changes and modifications can be made to the above-described catalytic converter without departing from the spirit of the invention. Such changes are contemplated by the inventor and he does not wish to be limited except by the scope of the appended claims.

The embodiments of the invention in which an exclusive property or privilege is claimed are defined as follows:

1. A by-pass flow catalytic converter for use in the exhaust system of an internal combustion engine, said catalytic converter including a housing having a cavity formed therein and terminating at one end with a gas inlet edge and terminating at the other end with a gas outlet edge, a pair of end members, one of said end members sealingly connected to the gas inlet edge of said housing and the other of said end members sealingly connected to said gas outlet edge of said housing, one of said end members having a gas inlet opening and the other of said end members having a gas outlet opening for allowing exhaust to pass through said gas outlet opening, a tube located in said cavity of said housing and axially aligned with said gas inlet opening and said gas outlet opening, said tube having a gas inlet end and a gas outlet end, said gas outlet end of said tube being supported by said other of said end members, a catalyst coated substrate wrapped with a mat of insulating material and located on diametrically opposed sides of said tube and having a plurality of parallel passages through which the exhaust gas from said engine is adapted to flow and be treated by said substrate, said substrate having a gas inlet face and a gas outlet face, said gas inlet face being spaced from said one of said end members to form a gas inlet chamber and said gas outlet face being spaced from said other of said end members to form a gas outlet chamber, said gas inlet end of said tube terminating at a point substantially transversely aligned with said gas inlet face of said substrate and having a valve supported therein for movement between a first position wherein said gas inlet end of said tube is closed and a second position wherein said gas inlet end of said tube is opened, said gas outlet end of said tube having an opening in the side wall of said tube for allowing communication between said gas outlet chamber and said gas outlet opening, an actuator connected to said valve for moving said valve from said first position wherein said exhaust gas entering said gas inlet chamber flows through said substrate and through said opening in said side wall to said gas outlet opening, said actuator adapted to move said valve to said second position wherein said exhaust gas entering said gas inlet chamber by-passes said substrate and flows directly through said tube.

2. The by-pass flow catalytic converter of claim 1 wherein said actuator includes a motor housing supporting a diaphragm which divides said motor housing into a first chamber and a second chamber, a link connected at one end to said diaphragm and connected at the other end to said valve, said first chamber of said motor housing communicating with said gas inlet chamber, a spring located in said second chamber of said motor housing and normally urging said diaphragm in a direction to cause said link to move said valve to said second position, and a source of vacuum adapted to be connected to said second chamber so as to cause said diaphragm to move in a direction to cause said link to move said valve to said first position.

3. The by-pass flow catalytic converter of claim 2 wherein said motor housing is provided with a passage sealingly connected at one end to said gas inlet chamber and sealingly connected at the other end of said passage to said first chamber of said motor housing for providing communication between said gas inlet chamber and said first chamber.

4. The by-pass flow catalytic converter of claim 3 wherein said link extends through said passage.

5. The by-pass flow catalytic converter of claim 4 wherein said link is provided with a member which is adapted to shield said passage when said valve is located in said first position.

6. A by-pass flow catalytic converter for use in the exhaust system of an internal combustion engine, said catalytic converter including a housing having a cavity formed therein and terminating at one end with a gas inlet edge and terminating at the other end with a gas outlet edge, a pair of end members, one of said end members sealingly connected to the gas inlet edge of said housing and the other of said end members sealingly connected to said gas outlet edge of said housing, one of said end members having a gas inlet opening and the other of said end members having a gas outlet opening for allowing exhaust to pass through said outlet opening, a tube located in said cavity of said housing and axially aligned with said gas inlet opening and said gas outlet opening, said tube having a gas inlet end and a gas outlet end, said gas outlet end of said tube being supported by said other of said end members, a pair of catalyst coated substrates wrapped with a mat of insulating material located on diametrically opposed sides of said tube and having a plurality of parallel passages through which the exhaust gas from said engine is adapted to flow and be treated by said substrate, each of said substrates having a gas inlet face and a gas outlet face, said gas inlet face of each of said substrates being spaced from said one of said end members to form a gas inlet chamber and said gas outlet face of each of said substrates being spaced from said other of said end members to form a gas outlet chamber, said gas inlet end of said tube terminating at a point substantially transversely aligned with said gas inlet face of each of said substrates and having a valve supported therein for movement between a first position wherein said gas inlet end of said tube is closed and a second position wherein said gas inlet end of said tube is open, said gas outlet end of said tube having at least one opening in the side wall of said tube for allowing communication between said gas outlet chamber and said gas outlet opening, an actuator connected to said valve for moving said valve from said first position wherein said exhaust gas entering said gas inlet chamber flows through said substrates and through said opening in said side wall to said gas outlet opening, said actuator adapted to move said valve to said second position wherein said exhaust gas entering said gas inlet chamber by-passes said substrates and flows directly through said tube to said gas outlet opening.

7. A by-pass flow catalytic converter for use in the exhaust system of an internal combustion engine, said catalytic converter including a housing having a cavity formed therein and terminating at one end with a gas inlet edge and terminating at the other end with a gas outlet edge, a pair of end members, one of said end members sealingly connected to the gas inlet edge of said housing and the other of said end members sealingly connected to said gas outlet edge of said housing, one of said end members having a gas inlet opening and the other of said end members having a gas outlet opening for allowing exhaust to pass through said outlet opening, a tube located in said cavity of said housing and axially aligned with said gas inlet opening and said gas outlet opening, said tube having a gas inlet end and a gas outlet end, said gas outlet end of said tube being supported by said other of said end members, a pair of catalyst coated ceramic substrates wrapped with a mat of insulating material located on diametrically opposed sides of said tube and having a plurality of parallel passages through which the exhaust gas from said engine is adapted to flow and be treated by said substrate, each of said substrates having a gas inlet face and a gas outlet face, said gas inlet face of each of said substrates being spaced from said one of said end members to form a gas inlet chamber and said gas outlet face of each of said substrates being spaced from said other of said end members to form a gas outlet chamber, said gas inlet end of said tube terminating at a point substantially transversely aligned with said gas inlet face of each of said substrates and having a valve supported therein for movement between a first position wherein said gas inlet end of said tube is closed and a second position wherein said gas inlet end of said tube is open, said gas outlet end of said tube having a plurality of openings in the side wall of said tube for allowing communication between said gas outlet chamber and said gas outlet opening, a vacuum operated actuator connected to said valve for moving said valve from said first position wherein said exhaust gas entering said gas inlet chamber flows through said substrates and through said openings in said side wall of said tube, said actuator adapted to move said valve to said second position wherein said exhaust gas entering said gas inlet chamber by-passes said substrates and flows directly through said tube to said gas outlet opening.

8. The by-pass flow catalytic converter of claim 7 wherein said actuator includes a motor housing supporting a diaphragm which divides said motor housing into a first chamber and a second chamber, a link connected at one end to said diaphragm and connected at the other end to said valve, said first chamber of said motor housing communicating with said gas inlet chamber, a spring located in said second chamber of said motor housing and normally urging said diaphragm in a direction to cause said link to move said valve to said second position, and a source of vacuum adapted to be connected to said second chamber so as to cause said diaphragm to move in a direction to cause said link to move said valve to said first position.

9. The by-pass flow catalytic converter of claim 8 wherein said motor housing is provided with a passage sealingly connected at one end to said gas inlet chamber and sealingly connected at the other end of said passage to said first chamber of said motor housing for providing communication between said gas inlet chamber and said first chamber.

10. The by-pass flow catalytic converter of claim 9 wherein said link extends through said passage.

11. The by-pass flow catalytic converter of claim 10 wherein said link is provided with a metallic member which is adapted to shield said passage when said valve is located in said first position.

* * * * *